US005488908A

United States Patent [19]

Gilpin et al.

[11] Patent Number: 5,488,908

[45] Date of Patent: Feb. 6, 1996

[54] ENVIRONMETALLY INSENSITIVE ELECTRIC DETONATOR SYSTEM AND METHOD FOR DEMOLITION AND BLASTING

[75] Inventors: Paul C. Gilpin, 6534 Wakopa Ct., Fort Wayne, Ind. 46815; David Gladstone, Ottawa, Canada

[73] Assignees: Paul C. Gilpin; Magnavox Electronic Systems Company, both of Fort Wayne, Ind.

[21] Appl. No.: 231,564

[22] Filed: Apr. 22, 1994

[51] Int. Cl.[6] ..... F42C 15/00; F42B 3/10

[52] U.S. Cl. ..... 102/200; 102/202.1; 102/202.7; 102/206

[58] Field of Search ..... 102/200, 202.1, 102/202.5, 202.7, 206

[56] References Cited

U.S. PATENT DOCUMENTS

| | | | |
|---|---|---|---|
| 4,145,970 | 3/1979 | Hedberg et al. | 102/218 |
| 4,441,427 | 4/1984 | Barrett | 102/202.6 |
| 4,602,565 | 7/1986 | MacDonald et al. | 102/202.7 |
| 4,762,067 | 8/1988 | Barker et al. | 102/313 |
| 4,777,878 | 10/1988 | Johnson et al. | 102/202.5 |
| 4,860,653 | 8/1989 | Abouav | 102/200 |

*Primary Examiner*—Stephen C. Bentley
*Assistant Examiner*—Theresa M. Wesson
*Attorney, Agent, or Firm*—John H. Crozier; Richard T. Seeger

[57] ABSTRACT

In a preferred embodiment, an environmentally insensitive electric detonator system for demolition, including: an object to be demolished; a main explosive charge in proximity to the object to be demolished; electrically activated detonator apparatus including a relatively insensitive initiating charge in proximity to the main explosive charge; and circuitry having input apparatus to receive an input firing pulse and having output apparatus to provide, through arbitrarily long wires, a high voltage in response thereto across the electrically activated detonator apparatus to cause ignition of the main explosive charge.

5 Claims, 3 Drawing Sheets

ENVIRONMETALLY INSENSITIVE ELECTRIC DETONATOR SYSTEM AND METHOD FOR DEMOLITION AND BLASTING

BACKGROUND OF THE INVENTION

1. Field of the Invention.

The present invention relates to demolition and blasting generally, e.g., in mines quarries, construction, for example, and, more particularly, but not by way of limitation, to an environmentally insensitive electric detonator system and method for initiating demolition and blasting explosives, fuels, pyrotechnics, and similar explosive items.

2. Background Art

High explosives have been widely used in demolition and blasting work for more than 100 years. The initiators used with such explosives are typically quite environmentally sensitive and employ such materials as lead azide or lead styphnate. Being environmentally sensitive, such materials are subject to unintentional detonation by fire, high temperature, mechanical shock and vibration, electrostatic discharge, and electromagnetic fields, the latter two conditions deriving from the use of long lengths of wires interconnecting actuating and explosive devices. Unintentional detonation presents a substantial safety hazard and serious injuries and deaths have resulted from the use of sensitive materials in demolition work. Safety precautions necessary when using sensitive explosives add to complexity and cost of demolition and blasting operations.

A need exists in demolition, blasting, and similar applications for an environmentally insensitive electrical detonator system. It is believed that such environmentally insensitive electrical detonator systems have been in use with munition detonation systems for at least 15–20 years; but, heretofore, have not been applied in demolition, blasting, and related fields and apparently have been unknown to those skilled in the art in those fields.

Accordingly, it is a principal object of the present invention to provide environmentally insensitive electric detonator system and method for use in demolition and blasting work and similar areas of activity.

It is a further object of the invention to provide such system and method that are safe, economical, and simple to deploy and operate.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an environmentally insensitive electric detonator system for demolition, comprising: an object to be demolished; a main explosive charge in proximity to said object to be demolished; electrically activated detonator means including a relatively insensitive initiating charge in proximity to said main explosive charge; and circuitry having input means to receive an input firing pulse and having output means to provide, through arbitrarily long wires, a high voltage in response thereto across said electrically activated detonator means to cause ignition of said main explosive charge.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
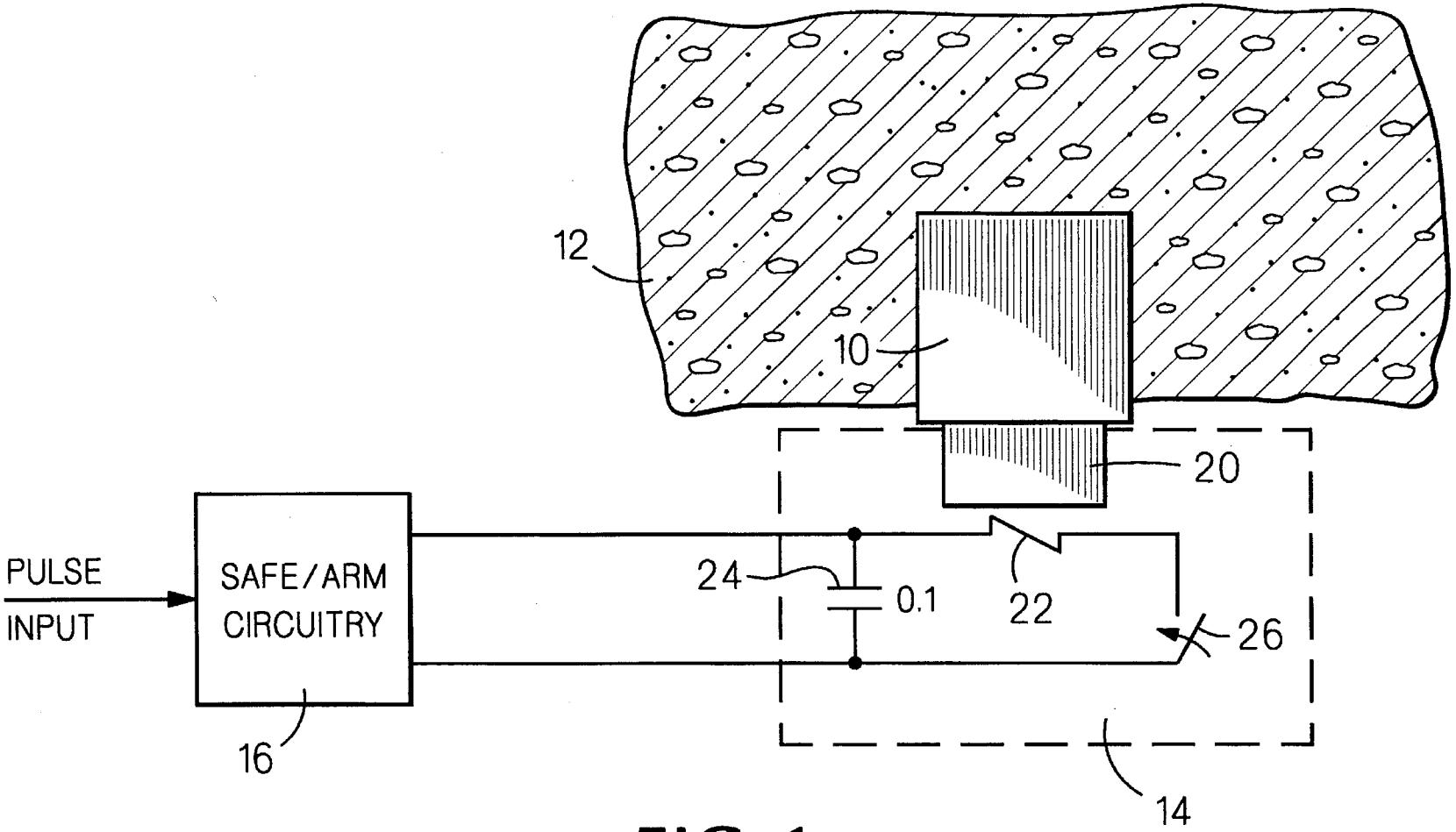
FIG. 1 is a fragmentary, block/schematic diagram illustrating the general arrangement of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates the general arrangement of the present invention for use in detonating a main explosive charge 10 which is shown as being embedded in a body of material 12 which comprises a portion of a building, rock, or other structure which is to be demolished or blasted. Disposed adjacent main explosive charge 10 is a fireset 14, including, in this case, an exploding foil initiator (EFI) and associated insensitive explosive 20, which receives charging current from firing and safe/arm circuitry 16. Safe/arm circuitry 16 receives a pulse input from an initiating source, such as a remote RF receiver or a conventional blasting machine (neither shown), the pulse input having, in this case, an amplitude of about 60–100 volts and a duration of about 250 seconds nominal. Elements 14 and 16 are similar to elements noted above as having been used in munitions detonating systems for at least 15–20 years.

Fireset 14 includes an initiating charge 20 of an environmentally insensitive explosive material, such as hexanitrostilbene, adjacent which is an exploding foil initiator 22. In use, safe/arm circuitry 16 outputs a DC voltage which is received by fireset 14. This DC voltage charges a capacitor 24. When the voltage reaches a predetermined level, an overvoltage switch 26 closes, causing capacitor 24 to discharge through exploding foil initiator 22, thus detonating initiating charge 20.

Figure 2A:
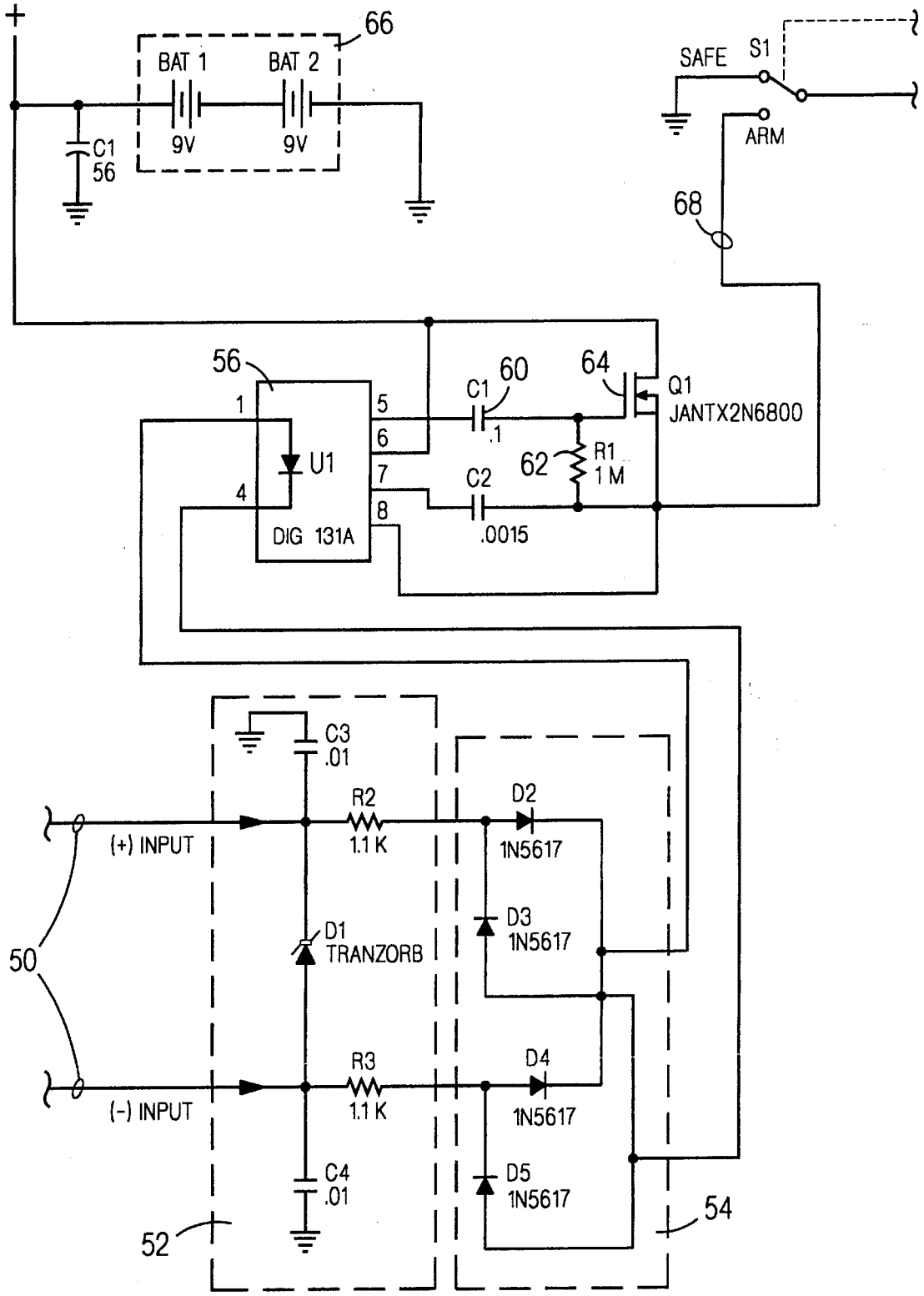
FIGS. 2A and 2B together comprise a schematic diagram of safe/arm circuitry employed in the present invention.
Figure 2B:
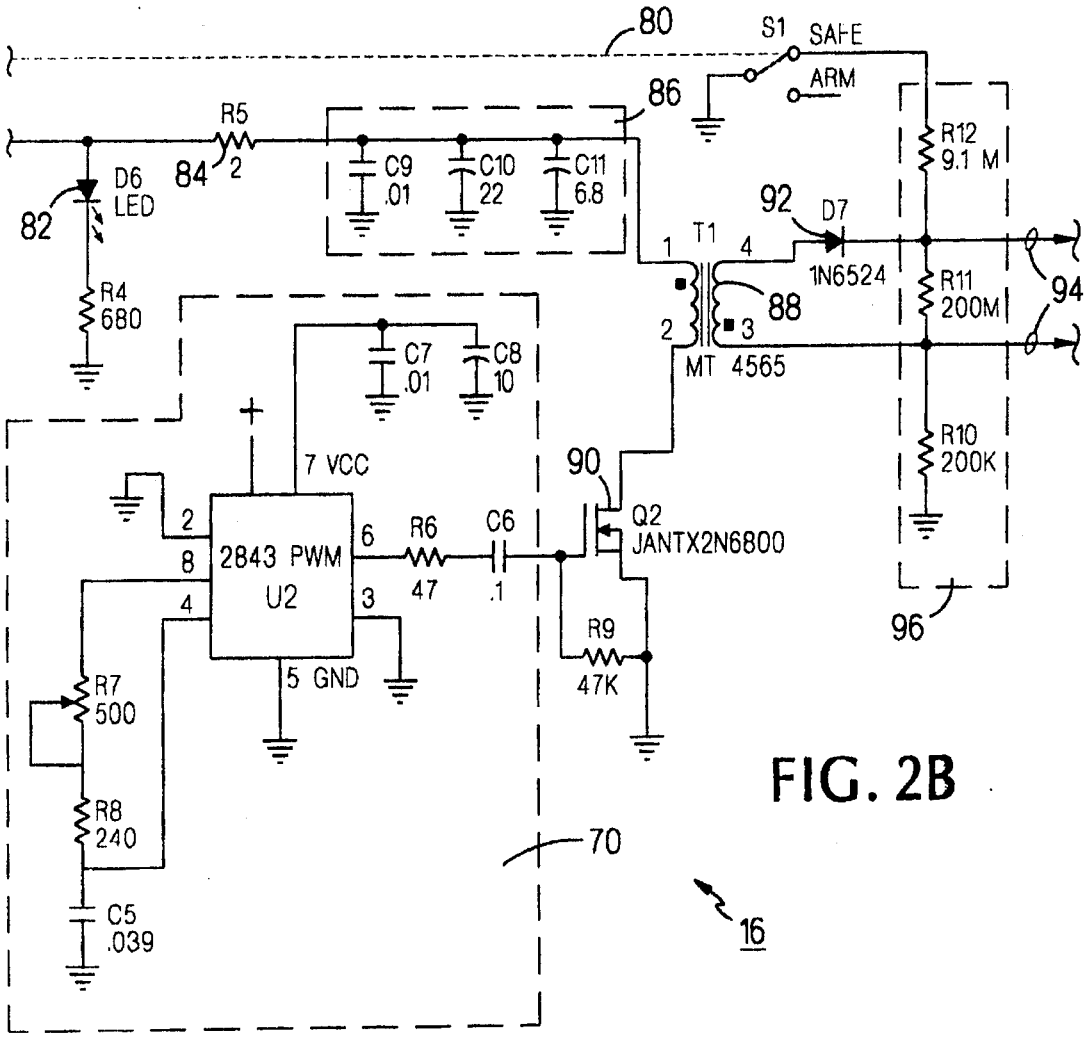
Figure 2C:
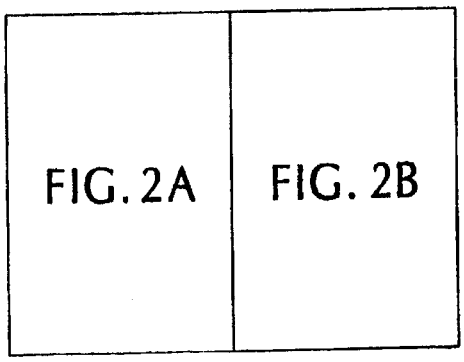
FIG. 2C illustrates the arrangement of FIGS. 2A and 2B for the reading thereof.

Referring now to FIG. 2, safe/arm circuitry 16 includes input leads 50 connected to a filter circuit 52 which is provided to absorb overvoltage and noise conditions. The output of filter circuit 52 is connected to a fullwave rectifier circuit 54 which provides a DC pulse to an optocoupler 56. A capacitor 60 and a resistor 62 are connected as shown to the output of optocoupler 56 to provide a short pulse, about 0.25 second or less, of base drive current to a pass transistor 64. When transistor 64 conducts, it passes a high level of current from batteries 66 to a lead 68. Batteries 66 also provide power to a 20–40 KHz oscillator circuit 70.

Lead 68 is connected to a safe/arm switch 80 which, when closed and a current pulse is subsequently received from pass transistor 64, causes an LED 82 to light for the duration of the pulse. The current pulse flows through a current limiting resistor 84 and a filter circuit 86 to one side of the primary of a step-up transformer 88. The other side of the primary is connected to ground through a transistor 90 which is driven by oscillator circuit 70 to provide a pulsing current through the primary. The approximately 3000-volt (open circuit) output of transformer 88 is rectified by a diode 92 and transmitted on arbitrarily long output leads 94 to slapper detonator 14 (FIG. 1). A resistor network 96 connected to output leads 94 provides for rapid discharge when safe/arm switch 80 is moved to the "safe" position. Network 96 also provides for a relatively slow discharge upon removal of power and also discharges undesired voltages on fireset 14.

Component values shown on FIG. 2 are in ohms for resistors and microfarads for capacitors.

So configured, the present invention is environmentally insensitive to the above-described conditions that present a safety hazard with conventional demolition systems. The system is economical to construct and simple to operate. The inputs and outputs of safe/arm circuitry 16 are polarity insensitive, further rendering the system simple to operate. Safe/arm circuitry 16 has an internal time limit of less than one second to preclude the circuitry from remaining powered after the input fire pulse has been applied. Safe/arm circuitry 16 can be connected to fireset 14 through arbitrarily long leads. By the nature of fireset 14, it cannot be initiated unintentionally, with or without long leads connected thereto, thereby achieving the object of environmental insensitivity.

It is also possible to provide firing and control circuitry 16 as manually operated, rather than receiving an input firing pulse. Other initiating events may be based on mechanical, radar, acoustic, IR, laser, and other similar devices. Firing and control circuitry 16, whether manually or remotely operated, may include an electrical or mechanical timer to delay the output therefrom.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An environmentally insensitive electric detonator system for demolition or blasting, comprising:

(a) an object to be demolished;

(b) a main explosive charge in proximity to said object to be demolished;

(c) electrically activated detonator means including a relatively insensitive initiating charge in proximity to said main explosive charge;

(d) firing and control circuitry having input means to receive an input firing pulse and having output means to provide a high voltage in response thereto across said electrically activated detonator means to cause ignition of said main explosive charge; and (e) wherein said electrically activated detonator means and said firing and control circuitry can be directly interconnected for an arbitrarily long period of time before providing said high voltage, without causing an increase in a safety hazard.

2. A detonator system, as defined in claim 1, wherein said electrically activated detonator means includes:

(a) tan exploding foil initiator to initiate said insensitive initiating charge;

(b) means to accumulate an electric charge; and (c) means to very rapidly discharge said accumulated electric charge through said exploding foil initiator to cause initiation of said insensitive initiating charge.

3. An environmentally insensitive method of demolishing an object, comprising:

(a) placing a main explosive charge in proximity to said object to be demolished;

(b) placing an electrically activated detonator including a relatively insensitive initiating charge in proximity to said main explosive charge;

(c) receiving an input firing pulse and providing a high voltage in response thereto across said electrically activated detonator to cause ignition of said main explosive charge, said receiving and providing steps being electrically isolated; and (d) said method including directly interconnecting said electrically activated detonator means and said firing and control circuitry for an arbitrarily long period of time before providing said high voltage, without causing an increase in a safety hazard.

4. A detonator system, as defined in claim 1, wherein: said electrically activated detonator means and said firing and control circuitry are interconnected by arbitrarily long leads.

5. A method, as defined in claim 3, further comprising: providing said high voltage to said electrically activated detonator means across arbitrarily long leads.

* * * * *